United States Patent [19]

Kirk

[11] 4,034,901

[45] July 12, 1977

[54] DRIPLESS SPOUT FOR PAINT CANS

[76] Inventor: Norman Kirk, 9 Rosedale Ave., Montclair, N.J. 07042

[21] Appl. No.: 722,553

[22] Filed: Sept. 13, 1976

Related U.S. Application Data

[63] Continuation-in-part of Ser. No. 569,458, April 18, 1975, abandoned.

[51] Int. Cl.[2] ..... B65D 25/48

[52] U.S. Cl. ..... 222/481.5; 222/570

[58] Field of Search ..... 222/478, 479, 481.5, 222/567, 570, 540, 568; 220/25, 29, 40, 55.1, 855 P

[56] References Cited

U.S. PATENT DOCUMENTS 3,672,547 6/1972 Kozlowski ..... 222/567

3,750,722 8/1973 Nowak ..... 141/332

*Primary Examiner*—Allen N. Knowles
*Assistant Examiner*—Norman L. Stack, Jr.
*Attorney, Agent, or Firm*—Richard L. Miller

[57] ABSTRACT

A spout is disclosed for use to pour paint from a paint can without the paint dripping down an outer side of the can; the spout being integrally formed upon a paint can lid that fits in the circular groove on the top of a paint can, the spout being curved and containing a flexible hose or tubing that extends curvedly the full length of the spout so to serve as an air return vent, the tubing being fixedly held at its opposite ends so that the portion thereof along a center of the spout is thus free to lash about and whip the paint as it pours past the same.

3 Claims, 5 Drawing Figures

DRIPLESS SPOUT FOR PAINT CANS

This invention is a continuation-in-part application of Ser. No. 569,458, now abandoned, filed on Apr. 18, 1975, by the applicant of the present invention.

This invention relates generally to pouring spouts for use on paint cans.

It is generally well known to most persons that pouring paint from a paint can is a messy operation. The paint invariably drips or runs down the outside of the can so that it requires to be wiped with a rag before it runs down on a floor.

Also the paint always clogs the circular groove around the paint can opening so that when the lid is therefore pressed into the groove, the paint runs outwardly of the groove requiring additional wiping and the remaining paint in the groove becoming hard therein so that it is not possible thereafter to seal the lid tightly. This is objectionable so that the situation is therefore in want of an improvement.

Accordingly, it is a principal object of the present invention to provide a spout for a paint can which is dripless so to not run into the can top groove and down an outside of the can, the spout additionally including a novel feature of whipping the paint as it is poured through the spout so to be more thoroughly mixed for use.

Another object is to provide a spout which is incorporated into a paint can lid that can be tightly pressed into the circular groove on the can top so that no paint leaks between the lid and can.

Yet another object is to provide a dripless spout for paint cans which can be readily transferred to a new can of paint after an old can is used up so that it can be re-used indefinitely.

Yet a further object is to provide a dripless spout for paint cans wherein an air return vent is contained within the spout so to be unexposed where it is subject to become clogged with dirt getting thereinto, or be subject for the can of paint to splash outwardly therethrough.

Yet a further object is to provide a dripless spout for paint cans which be preventing spilling of paint, saves on paint cost and saves on time to clean up spilled paint.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
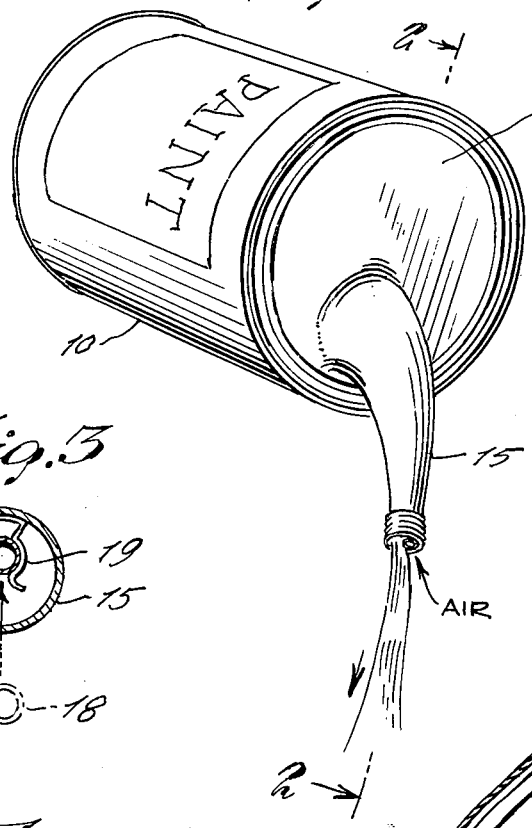
FIG. 1 is a perspective view of the present invention shown in operative use pouring paint out of a paint can.
Figure 4:
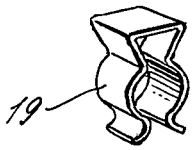
FIG. 4 is a perspective view of a typical clip that retains the air return vent hose.
Figure 3:
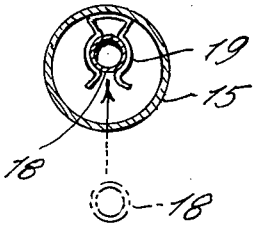
FIG. 3 is an enlarged cross-sectional view on line 3—3 of FIG. 2 and illustrating the detail of the spout end.

Referring now to the drawings in greater detal, wherein there is a paint can 10 of conventional type, having an opening on top that is closable by a removable, metal lid 11. The paint can includes a circular groove 12 around the central opening formed in the top wall 13 of the can, and into this groove there is received a correspondingly circular bead 14 pressed downwardly on the underside of the lid 11, so to form a tight seal between the lid and can.

Figure 2:
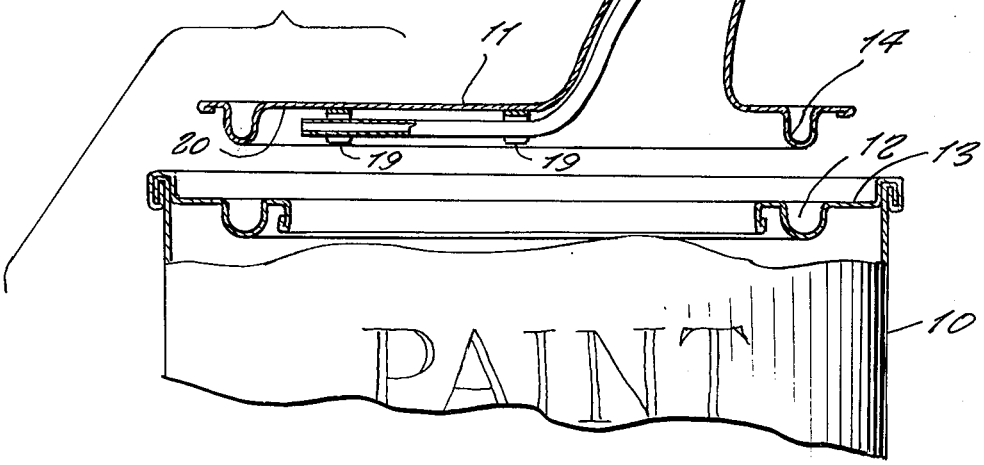
FIG. 2 is an enlarged cross-sectional view taken on line 2—2 of FIG. 1.
Figure 5:
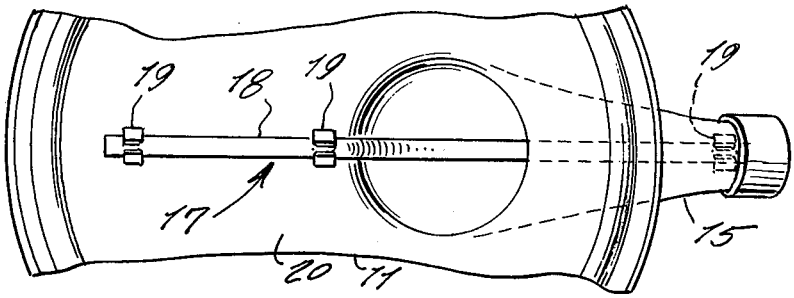
FIG. 5 is a fragmentary bottom view of the paint can lid shown incorporating the dripless spout therewith.

A spout 15 is formed upon the lid so to permit pouring paint outwardly from the can in a neat manner, the spout extending arcuately upwardly and forwardly to a spout end that extends sidewardly beyond the cylindrical side wall of the can, as clearly shown in FIG. 2. The spout tapers from the base to its outer end gradually.

The end of the spout is externally screw-threaded and a removeable end cap 16 has an internal screw thread for securement thereupon, thus hermetically sealing a paint contained in the can and preventing it to splash accidentally outwardly or letting air to get inside and dry up the paint.

Within the interior of the spout, an air return vent 17 is installed so to permit air to enter the can during a paint-pouring operation and relieve the low air pressure which otherwise would retard the paint pouring operation. The vent 17 consists of a length of flexible plastic tubing 18 which extends from the spout end to a base end of the spout, and a tail end of the tubing then extends along an underside of the lid 11.

The tubing is secured in position by means of three clips 19 made of a flexible leaf-spring metal so to snap around the tubing; the clips being rigidly spot-welded to the spout and lid; one of the clips being affixed within the spout end, while the other two are affixed on the underside 20 of the lid, one of the two clips being adjacent the base end of the spout while the other holds the tail end of the tubing close to the bead 14.

It will be noted that each clip includes a pair of legs which at their centers are bent arcuately away from each other so to form a circular space therebetween for grasping around the tubing. A midportion of the clip includes a short flat face for abutting against the lid or spout surface so to be welded thereto.

As clearly shown in FIG. 2, the portion of the tubing 18 between the opposite ends of the spout is left unsupported so to be free in order to lash about within the spout. The tubing is not stretched taut between the opposite ends of the spout but is loosely made to follow the general arcuate contour of the spout. Thus there is a greater length of tubing in the spout than if such tubing were made taut.

In operative use, it is now evident that paint may be poured outwardly of the can in a neat manner without clogging the groove 14 or running down an outer side of the paint can. The vent 17 allows air to enter the can during the pouring operation so that the paint flows outwardly without being retarded by a vacuum.

During the pouring operation, the flow of paint past the freely loose intermediate portion of the tubing 18 will cause the tubing to lash sidewardly thus mixing the paint as it is dispensed.

It should also be noted that the axial carve of the spout is sufficiently acute so that the tubing 18 will lash against opposite major and minor curved surfaces thereof, as clearly shown in FIG. 2. Thus an imaginary straight line between the centers of opposite ends of the spout will be intercepted by the minor curve.

After the pouring is completed, the cap 16 is screwed on the spout thus closing both the spout and vent so that no paint can spill out nor air can enter to dry out the paint.

After a long or extensive use, the vent may become clogged with paint, and it can then be cleaned out with a suitable paint solvent, or else it may be removed and easily replaced by a fresh tubing.

Thus an improved dripless spout is provided for a paint can.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. In a dripless paint can spout assembly, the combination of a paint can, a removable lid on said can, as circular, downward groove around a central opening on a top wall of said can, a circular downward bead on said lid engageable in said groove, and a spout formed on said lid; said spout containing an air vent comprised of a replaceable, flexible plastic tube of smaller diameter than a cross sectional size of said spout, said tube extending from a tip of said spout, through an entire length of said spout and adjacent an underside of said lid, a plurality of spring clips secured on said lid underside and inside said spout, said spring clips replaceably receiving and snap fitting around said tube; said spout being axially curved and tapered toward an outlet end, a first of said clips being secured near an outlet end of said spout, said flexible tube extending freely inside said curved tube from said clip at said outlet to a second of said clips secured on said lid underside and located adjacent an entry of said spout, a portion of said tube between said first and second clips, and between opposite ends of said arcuate spout being installed with a same arcuate curved as said spout, whereby said tube portion is free to flex and whip a paint during a pouring operation.

2. The combination as set forth in claim 1 wherein one of said clips is mounted within an outward end of said spout is screw threaded, and a removable end cap is correspondingly threaded for removable placement upon said spout, said end cap thus closing both said spout and said vent from an atmosphere.

3. The combination as set forth in claim 2 wherein said spout has an axial curve sufficiently acute whereby a longitudinal midportion of said spout intersects an imaginary straight line between the centers of opposite ends of said spout.

* * * * *